United States Patent [19]

Masuda et al.

[11] 4,253,175

[45] Feb. 24, 1981

[54] TIME DATA PROCESSING CIRCUIT FOR ELECTRONIC TIMEPIECE

[75] Inventors: Eiji Masuda, Kawasaki; Teruaki Tanaka; Tetsuo Yamaguchi, both of Yokohama; Hiroaki Suzuki, Tokyo, all of Japan

[73] Assignee: Tokyo Shibaura Denki Kabushiki Kaisha, Japan

[21] Appl. No.: 19,572

[22] Filed: Mar. 12, 1979

[30] Foreign Application Priority Data

Mar. 16, 1978 [JP] Japan ..... 53/30242

[51] Int. Cl.[3] ..... G04C 19/00

[52] U.S. Cl. ..... 368/85; 368/69; 368/70; 235/92 T

[58] Field of Search ..... 58/23 R, 23 A, 50 R, 58/85.5; 235/92 T; 307/221 R; 368/85, 69, 70

[56] References Cited

U.S. PATENT DOCUMENTS

| | | | |
|---|---|---|---|
| 3,788,058 | 1/1974 | Idei et al. | 58/23 R |
| 3,798,428 | 3/1974 | Izawa | 58/23 R X |
| 3,986,333 | 10/1976 | Kimura et al. | 58/23 R X |
| 3,988,886 | 11/1976 | Kashio | 58/23 R |
| 4,092,819 | 6/1978 | Takase | 58/23 R |
| 4,132,060 | 1/1979 | Kashio | 58/23 R |

*Primary Examiner*—Ulysses Weldon

*Attorney, Agent, or Firm*—Finnegan, Henderson, Farabow, Garrett & Dunner

[57] ABSTRACT

A time data processing circuit for an electronic timepiece comprises a common line; a signal generator for generating time data signal and first, second, third and fourth control signals; first and second shift register circuits; an arithmetic operation circuit for processing the time data signal and the output signal of the first shift register circuit; a first input/output circuit for coupling, in response to the first control signal, the output terminal of the arithmetic operation circuit to the common line and the input terminal of the first shift register circuit and coupling, in response to the second control signal, the common line to the input terminal of the first shift register circuit; and a second input/output circuit for coupling, in response to the third control signal, the output terminal of the second shift register circuit to the input terminal of the second shift register circuit and the common line and coupling, in response to the fourth control signal, the input terminal of the second shift register circuit to the common line.

11 Claims, 2 Drawing Figures

TIME DATA PROCESSING CIRCUIT FOR ELECTRONIC TIMEPIECE

BACKGROUND OF THE INVENTION

This invention relates to a time data processing circuit for an electronic timepiece.

One of the known time-counting systems for electronic timepieces such as electronic watches is shift register time-counting system. In this system, time data are circulated in a loop circuit including shift registers, and a specific time data is added to the circulating time data every time, for example, the time data circulate one in the loop circuit. Recently, an electronic watch has been given more and more functions. More function data are therefore serially circulated together with time data in the loop circuit of the shift register time-counting system. As the number of data bits increases, it becomes necessary to use shift registers of larger bit capacity. To circulate more data bits within the time necessary for circulating time data and a fewer function data, it is necessary to circulate them with a considerably high speed. To achieve such a high speed circulation of data bits, the frequencies of various timing signals including shift pulses should be set high. As a result, it becomes necessary to change the frequency of pulses used to represent the smallest unit of time in stop watch function, and the power comsumption inevitably increases.

SUMMARY OF THE INVENTION

It is an object of this invention to provide a time data processing circuit for an electronic timepiece, which has a simple construction and performs various functions.

According to an embodiment of the invention, there is provided a time data processing circuit for an electronic timepiece comprising a common line; first and second shift register circuits; operation means coupled at a first input terminal to an output terminal of the first shift register circuit and receiving at a second input terminal a time data signal for arithmetically processing the input signals; a first input/output means for coupling, at a first position, the operation means to both the common line and the input terminal of the first shift register and coupling, at a second position, the common line to the input terminal of the first shift register circuit; and a second input/output circuit for coupling, at a first position, the output terminal of the second shift register circuit to both the common line and the input terminal of the second shift register circuit and coupling, at a second position, the common line to the input terminal of the second shift register circuit.

DETAILED DESCRIPTION OF THE PREFERRED EMBODIMENT

Now referring to FIGS. 1 and 2, an embodiment of this invention, a time data processing circuit for an electronic watch will be described.

Figure 1:
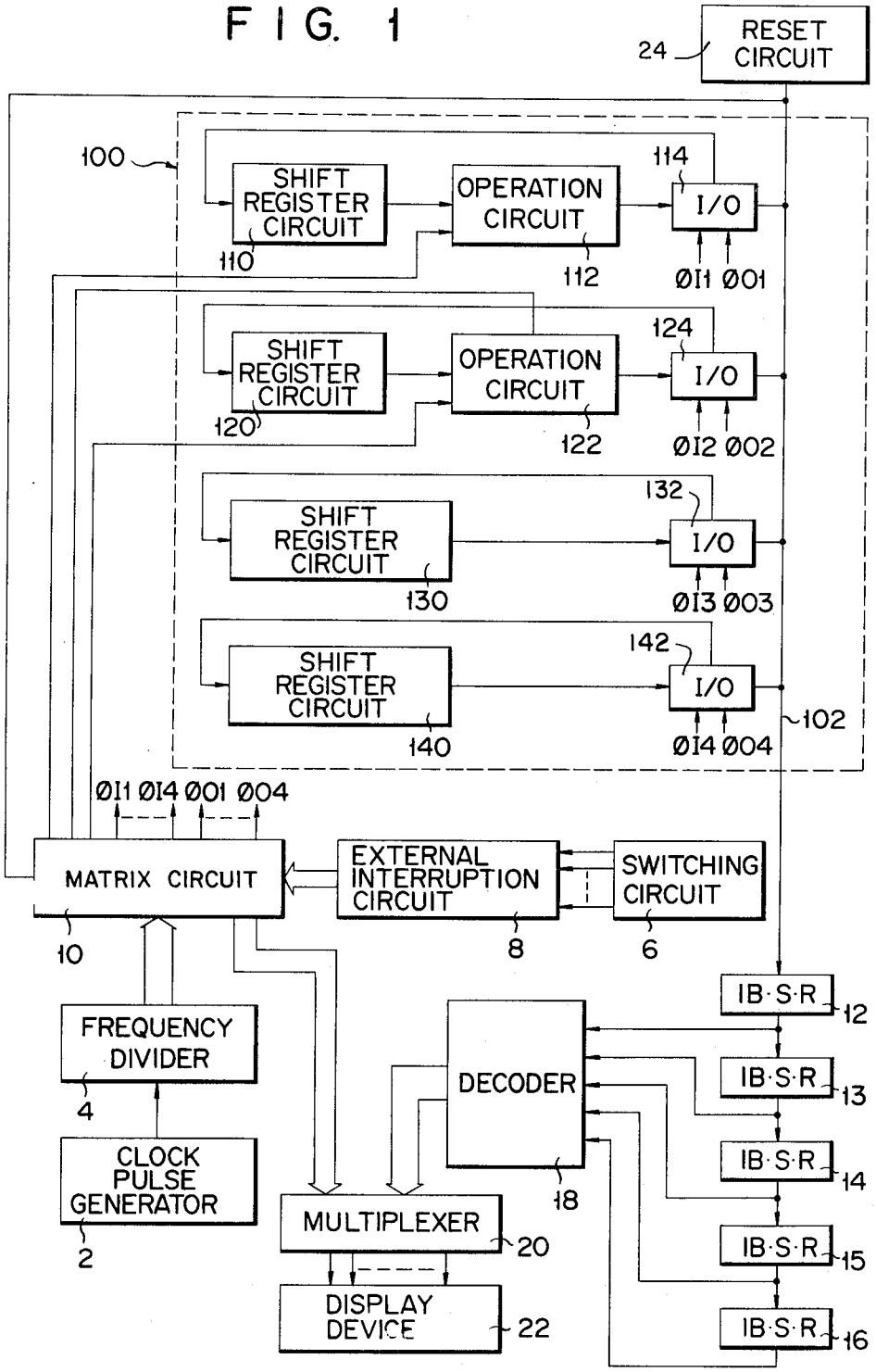
FIG. 1 is a block circuit diagram of an electronic watch using a time data processing circuit according to this invention.

The electronic watch shown in FIG. 1 has a clock pulse generator 2 such as a quartz oscillator, a frequency divider 4 for dividing the frequency of an output signal of the clock pulse generator 2 and a switching circuit 6 having a plurality of switches (not shown) for generating an output signal corresponding to the opening and closing of the switches. The watch further comprises an external interruption circuit 8 for generating an instruction signal in response to the output signal of the switching circuit 6, a matrix circuit 10 for processing the output signal of the frequency divider 4 properly in accordance with the instruction signal from the external interruption circuit 8 and thus generating time-counting pulses and timing pulses, and a time data processing circuit 100 for processing the pulse signals from the matrix circuit 10 and thus providing time information.

The external interruption circuit 8 is constituted by, for example, chattering-preventing circuits, synchronizing circuits, and a decoder. The matrix circuit 10 is constituted by, for example, a read only memory. Further, the electronic watch is provided with a shift register circuit comprised of five serially connected 1-bit shift registers 12 to 16, a decoder circuit 18, a multiplexer 20 and a display device 22.

The output terminals of the shift registers 12 to 16 are coupled to the decoder circuit 18, which receives the output data from the shift registers 12 to 16 and generates segment signals respectively designating display segments to be energized. The output data of the decoder circuit 18 is supplied to the multiplexer 20 which is controlled by a control signal from the matrix circuit 10. The multiplexer 20 supplies the display device 22 such as a liquid crystal display device with segment-energizing signal corresponding to the segment signal from the decoder circuit 18, thereby energizing the display segment (not shown) represented by the segment signal.

The time data processing circuit 100 has an output line or common line 102 which is coupled to the shift register circuit constituted by the shift registers 12 to 16. The circuit 100 further has four shift register circuits 110, 120, 130 and 140 which may have different bit capacities. The output terminal of the shift register circuit 110 is coupled to one input terminal of an operation circuit 112 which receives at the other input terminal time-counting pulses of, for example, 1 Hz or 128 Hz from the matrix circuit 10. The output terminal of the operation circuit 112 is coupled to an input/output circuit 114, which will later be described. The output line of the input/output circuit 114 is coupled to the input terminal of the shift register circuit 110. The input/output line of the circuit 114 is coupled to the common line 102. The operation circuit 112 performs various functions necessary for time-counting, such as half-addition and carry correction.

The output terminal of the shift register circuit 120 is coupled to one input terminal of an operation circuit 122 which receives at the other input terminal time-counting pulses of, for example, 1 Hz or 128 Hz from the matrix circuit 10. The output terminal of the operation circuit 122 is coupled to an input/output circuit 124 which is similar in structure to the input/output circuit 114. The output line of the input/output circuit 114 is coupled to the input terminal of the shift register circuit 120, and the input/output line of the circuit 114 is coupled to the common line 102. The operation circuit 122 performs half-subtraction in addition to the functions which the operation circuit 112 can perform. Similarly, the output terminals of the shift register circuits 130 and 140 are coupled to input/output circuits 132 and 142, respectively, which are similar in structure to the input-/output circuit 114. The output lines of these circuits 132 and 142 are coupled to the input terminals of the shift register circuits 130 and 140, respectively, and the input/output lines of them are coupled to the common line 102.

To the common line 102 there is coupled a reset circuit 24 which supplies a signal to the matrix circuit 10 when power is turned ON. In response to the signal from the reset circuit 24 the 10 produces pulses $\phi_{01}$, $\phi_{02}$, $\phi_{03}$ and $\phi_{04}$ of "1" level, which are supplied through the I/O circuits to reset the shift register circuits 110, 120, 130 and 140, respectively.

Figure 2:
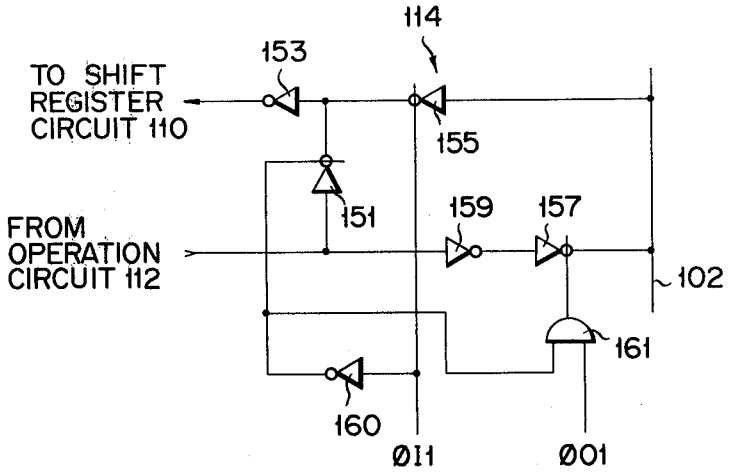
FIG. 2 is a circuit diagram of an input/output circuit used in the time data processing circuit shown in FIG. 1.

The input/output circuit 114, for example, is so constructed as shown in FIG. 2. It comprises a clocked inverter 151 coupled to the output terminal of the shift register circuit 110, an inverter 153 coupling the output terminal of the inverter 151 to the input terminal of the shift register circuit 110, a clocked inverter 155 with an input terminal coupled to the common line 102 and an output terminal coupled to the input terminal of the inverter 153, and a clocked inverter 157 which couples the output terminal of the shift register circuit 110 to the common line 102 via an inverter 159. A pulse $\phi$I1 from the matrix circuit 10 is supplied to a control terminal of the clocked inverter 155 and to a control terminal of the clocked inverter 151 via an inverter 160. A pulse $\phi_{01}$ from the matrix circuit 10 is supplied to one input terminal of an AND gate 161 which is coupled at the other input terminal to the inverter 160. The output terminal of the AND gate 161 is coupled to a control terminal of the clocked inverter 157.

Now there will be described how the electronic watch shown in FIG. 1 operates.

When a pulse $\phi$I1 of "0" level is supplied from the matrix circuit 10 to the input/output circuit 114, the clocked inverter 155 is made inoperative, and the clocked inverter 151 is made operative. The operation circuit 112 then supplies time data to the shift register circuit 110 via the inverters 151 and 153. That is, time data from the matrix circuit 10 is, for example, added to the time data in the shift register circuit 110 by means of the operation circuit 112, and the sum of these time data is entered into the shift register circuit 110 as new time data. When a pulse $\phi_{01}$ of "1" level is generated by the matrix circuit 10 and supplied to the input/output circuit 114, it is supplied to the clocked inverter 157 via the AND gate 161 enabled by an output signal of the inverter 160. Thus, the clocked inverter 157 is rendered operative, and the time data is transferred from the operation circuit 112 to the common line 102 through the inverters 159 and 157.

Thereafter, when a pulse $\phi$I1 of "1" level is generated by the matrix circuit 10, the clocked inverters 151 and 157 are made inoperative, and the clocked inverter 155 is made operative. Time data can therefore be transferred to the shift register circuit 110 via the common line 102 via the inverters 155 and 153.

So long as the switching circuit 6 is set in normal condition or a first state, the matrix circuit 10 supplies, in response to the output signals of the external interruption circuit 8, time data to the operation circuit 112, pulses $\phi$I1 of "0" level and pulses $\phi_{01}$ of "1" level to the input/output circuit 114 and display instruction signal to the multiplexer 20. Thus, the shift register circuit 110, the operation circuit 112 and the input/output circuit 114 cooperate to carry out time-counting operations in the above-mentioned way and to supply time data to the common line 102. The time data on the common line 102 are transferred one after another to the one-bit shift registers 12 to 16. The decoder 18 decodes the contents of the one-bit shift registers 12 to 16 to produce decoded output data. These decoded output data are supplied to the display device 22 through the multiplexer 20, thereby energizing the display segments which are designated by the decoded output data of the decoder 18. This is how the display device 22 displays the contents of the shift register 110. To stop or prohibit the display, the switching circuit 6 is set in a second state, whereby the matrix circuit 10 supplies display-prohibiting signals to the multiplexer 20.

The time data displayed by the display device 22 is corrected in the following way. First, the switching circuit 6 is set in a third state to make the matrix circuit 10 generate a pulse $\phi$I1 of "0" level, a pulse $\phi_{01}$ of "1" level and a pulse $\phi$I2 of "1" level, thereby transferring the time data in the shift register circuit 110 to the shift register circuit 120. Then, the switching circuit 6 is set in a fourth state to make the matrix circuit 10 generate a pulse $\phi$I1 of "1" level, a pulse $\phi$I2 of "0" level, a pulse $\phi_{02}$ of "1" level and a mode signal for determining the operation mode of the operation circuit 122. At the same time, the matrix circuit 10 is made to generate time data and to supply the same to the operation circuit 122. As a result, the contents of the shift register circuit 120 are changed by the operation circuit 122 according to the time data from the matrix circuit 10, and the output signals of the operation circuit 122 are supplied to the shift register circuit 120 through the input/output circuits 124 and 114. Upon completion of such time correction, the switching circuit 6 is brought back into the first state.

The shift register circuit 130 is used to, for example, store an alarm time data. Its output terminal is coupled to one input terminal of a comparator (not shown) which is connected at the other input terminal to the common line 102 and at the output terminal to an alarm device (not shown). It can therefore energize the alarm device when the time data in the shift register circuit 110 coincides with the time data in the shift register circuit 120. The contents of the shift register circuit 130 can be changed by transferring any desired time data to the shift register circuit 120 and then transferring the time data from the circuit 120 to the shift register circuit 130.

The shift register circuit 120 and the operation circuit 122 may cooperate to achieve stop watch operation if the shift register circuit 120 is reset and then is made to count time in accordance with the time data from the matrix circuit 10. In this case, lap time data obtained during the stop watch operation can be stored into the shift register circuit 140. This is done by keeping the switching circuit 6 in a specific state during the stop watch operation, thereby causing the matrix circuit 10 to generate a pulse $\phi$I2 of "0" level, a pulse $\phi$02 of "1" level and a pulse $\phi$I4 of "1" level.

The shift register circuits 110, 120, 130 and 140 may have different bit capacities and may thus store data each constituted by a different number of bits. Then it becomes possible to transfer part of time data stored in a shift register circuit of a large bit capacity to a shift register circuit of a small bit capacity, if necessary. This is achieved by generating timing signals $\phi$I1 to $\phi$I4 and $\phi_{01}$ to $\phi_{04}$, each according to a specific format. By selecting a format for each timing signal among many formats, it becomes possible to obtain through the common line 102 the time data from any of the shift register circuits 110, 120, 130 and 140, the time data from the shift registers 110 and 130 or 140 which have been mixed in time-sharing fashion, or the time data from the shift register circuits 120, 130 and 140 which have been mixed in time-sharing fashion.

What we claim is:

1. A time data processing circuit for an electronic timepiece comprising:

a common line;

means for generating time data signals;

a first shift register circuit having a first input terminal and a first output terminal, said first shift register circuit for producing first data signals for output by said first output terminal;

a second shift register circuit having a second input terminal and a second output terminal, said second shift register circuit for producing second data signals for output by said second output terminal;

a first operation circuit having a third input terminal coupled to said first output terminal for receiving said first data signals, a fourth input terminal for receiving said time data signals, and a third output terminal, said first operation circuit for arithmetically processing said received first data signals and said received time data signals to produce third data signals for output by said third output terminal;

a first input/output switching circuit for coupling (1) in a first selectable switching position, said third output terminal to said common line and to said first input terminal, and (2) in a second selectable switching position, said common line to said first input terminal; and a second input/output circuit for coupling (1) in a first selectable switching position said second output terminal to said common line and to said second input terminal, and (2) in a second selectable switching position said common line to said second input terminal.

2. A time data processing circuit according to claim 1 further comprising:

a third shift register circuit having a fifth input terminal and a fourth output terminal, said third shift register circuit for producing third data signals for output by said fourth output terminal;

a second operation circuit having a sixth input terminal coupled to said fourth output terminal for receiving said third data signals, a seventh input terminal for receiving said time data signals, and a fifth output terminal, said second operation circuit for arithmetically processing said received third data signals and said time data signals to produce fourth data signals for output by said fifth output terminal; and a third input/output switching circuit for coupling (1) in a first selectable switching position, said fifth output terminal to said common line and to said fifth input terminal, and (2) in a second selectable switching position; said common line to said fifth input terminal.

3. A time data processing circuit according to claim 1 or 2, further comprising:

a fourth shift register circuit having an eighth in put terminal and a sixth output terminal, and a fourth input/output circuit for coupling (1) in a first selectable switching position, said sixth output terminal to said common line and to said eighth input terminal, and (2) in a second selectable switching position, said common line to said eighth input terminal.

4. A time data processing circuit according to claim 1 or 2, wherein said first input/output circuit couples in a third selectable switching position said first output terminal to said first input terminal.

5. A time data processing circuit according to claim 1 or 2 wherein said first shift register circuit has a first bit capacity and said second shift register circuit has a second bit capacity, said second bit capacity being larger than said first bit capacity.

6. An electronic timepiece comprising:

means for generating timing control signals;

a switching circuit for producing a switching signal;

an interruption circuit for generating an interrupt signal in response to said switching signal;

a control circuit for generating a time data signal and a plurality of timing signals responsive to said timing control signals and said output signal generated by said interruption circuit; and a time data processing circuit comprising:

a common line;

a first shift register circuit having a first input terminal and a first output terminal, said first shift register circuit for producing first data signals for output by said first output terminal;

a second shift register circuit having a second input terminal and a second output terminal, said second shift register circuit for producing second data signals for output by said second output terminal;

a first operation circuit having a third input terminal coupled to said first output terminal for receiving said first data signals, a fourth input terminal for receiving said time data signals, and a third output terminal, said first operation circuit for arithmetically processing said received first data signals and said received time data signals to produce third data signals for output by said third output terminal;

a first input/output switching circuit for coupling (1) in a first selectable switching position, said third output terminal to said common line and to said first input terminal, and (2) in a second selectable switching position, said common line to said first input terminal; and a second input/output circuit for coupling (1) in a first selectable switching position, said second output terminal to said common line and to said second input terminal, and (2) in a second selectable switching position, said common line to said second input terminal.

7. A time data processing circuit according to claim 6 further comprising:

a third shift register circuit having a fifth input terminal in a fourth output terminal, said third shift register circuit for producing third data signals for output by said fourth output terminal;

a second operation circuit having a sixth input terminal coupled to said fourth output terminal for receiving said third data signals, a seventh input terminal for receiving said time data signals, and a fifth output terminal, said second operation circuit for arithmetically processing said received third data output signals and said time data signals to produce fourth data signals for output by said fifth output terminal; and a third input/output switching circuit for coupling (1) in a first selectable switching position, said fifth output terminal to said common line and to said fifth input terminal, and (2) in a second selectable switching position, said common line to said fifth input terminal.

8. A time data processing circuit according to claim 6 or 7, further comprising:

a fourth shift register circuit having an eighth input terminal and a sixth output terminal, and a fourth input/output circuit for coupling (1) in a first selectable switching position, said sixth output terminal to said common line and to said eighth input terminal, and (2) in a second selectable switching position, said common line to said eighth input terminal.

9. An electronic timepiece according to claim 6 or 7, further comprising a display device coupled to said common line.

10. An electronic timepiece according to claim 6 or 7, further comprising a reset circuit for generating a reset control signal and for supplying said reset control signal to said control circuit, said control circuit for generating first and second reset signals in response to the reception of said reset control signal and for supplying said first reset signal to said first shift register circuit through said common line and said second reset signal to said second shift register circuit through said common line to reset said first shift register circuit and said second shift register circuit, respectively.

11. An electronic timepiece according to claim 7, further comprising means for supplying a reset control signal to said control circuit, and wherein said control circuit generates first, second, and third reset signals in response to said reset control signal and (1) supplies said first reset signal to said first shift register circuit through said common line to reset said first shift register circuit, (2) supplies said second reset signal to said second shift register circuit through said common line to reset said second shift register circuit, and (3) supplies said third reset signal to said third shift register circuit through said common line to reset said third shift register circuit.

* * * * *